US006736099B2

(12) United States Patent
Mori et al.

(10) Patent No.: US 6,736,099 B2
(45) Date of Patent: May 18, 2004

(54) HYDRAULIC ENGINE-STARTING SYSTEM IN VEHICLE

(75) Inventors: Ryuichi Mori, Wako (JP); Junya Tachikawa, Wako (JP); Koichi Fushimi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 69 days.

(21) Appl. No.: 10/141,138

(22) Filed: May 9, 2002

(65) Prior Publication Data

US 2003/0000492 A1 Jan. 2, 2003

(30) Foreign Application Priority Data

May 15, 2001 (JP) ..... 2001-145460

(51) Int. Cl.[7] ..... F02N 7/00
(52) U.S. Cl. ..... 123/179.31; 60/626
(58) Field of Search ..... 123/179.31, 179.4; 60/625, 626, 627, 628

(56) References Cited

U.S. PATENT DOCUMENTS 3,654,758 A * 4/1972 Aoyama et al. ..... 123/179.31
6,460,500 B1 * 10/2002 Ooyama et al. ..... 123/179.3
6,615,786 B2 * 9/2003 Mori et al. ..... 123/179.31

FOREIGN PATENT DOCUMENTS

JP 8-14076 1/1996
JP 2000-46165 2/2000

* cited by examiner

*Primary Examiner*—Mahmoud Gimie
*Assistant Examiner*—Arnold Castro
(74) *Attorney, Agent, or Firm*—Arent Fox Kintner Plotkin & Kahn, PLLC

(57) ABSTRACT

A hydraulic engine-starting system for cranking and starting an engine for a vehicle having automatically stopping and starting functions by a hydraulic motor. A hydraulic pressure that operates a hydraulic clutch of a transmission is raised promptly by using a hydraulic motor. The hydraulic motor is driven by a hydraulic pressure supplied thereto through a first oil passage from a hydraulic motor-driving device including an oil pump, an accumulator and a solenoid valve, thereby starting the engine. A transmission is disposed in the middle of a second oil passage for returning an oil discharged from the hydraulic motor to the hydraulic motor-driving device. Thus, the hydraulic pressure in the transmission can be raised simultaneously with the start of the engine to enable the engagement of a hydraulic clutch, thereby starting the vehicle promptly, while avoiding generating a shock from the engagement of the hydraulic clutch.

12 Claims, 7 Drawing Sheets

HYDRAULIC ENGINE-STARTING SYSTEM IN VEHICLE

BACKGROUND OF THE INVENTION

1. Field of the Invention

The present invention relates to a hydraulic engine-starting system for starting an engine for a vehicle having automatic stopping and starting functions by cranking the engine using a hydraulic motor.

2. Related Art

Automatic engine-stopping and starting systems are known from Japanese Patent Application Laid-open Nos. 8-14076 and 2000-46165. They are designed so that when a vehicle is stopped during traveling and predetermined conditions are established, the engine is stopped automatically. Likewise, when an accelerator pedal is depressed to start the vehicle, the engine starts automatically, thereby saving fuel and reducing exhaust emission.

A hydraulic pressure that operates a hydraulic clutch of a transmission is generated by an oil pump driven by the engine. For this reason, when the engine is stopped upon stopping the vehicle, the oil pump also stops. Therefore, even if the engine is started at the start of the vehicle to drive the oil pump, it is difficult to immediately raise the hydraulic pressure required to operate the hydraulic clutch of the transmission. Raising of the hydraulic pressure for the transmission is retarded for this reason. Thus, the hydraulic clutch is brought into engagement after increasing the rotational speed of the engine, a shock is then generated by the engagement of the hydraulic clutch, and smooth starting of the vehicle is not possible.

In order to avoid this, the automatic engine-stopping and starting system described in Japanese Patent Application Laid-open No. 8-14076 includes a large-sized accumulator in which a hydraulic pressure is accumulated by an oil pump driven by the engine. In this system, a working oil is supplied from the accumulator to the transmission at the start of the engine to ensure a hydraulic pressure required for the engagement of the hydraulic clutch. The automatic engine-stopping and starting system described in Japanese Patent Application Laid-open No. 2000-46165 includes an electric oil pump separate from an oil pump driven by the engine so that the hydraulic clutch of the transmission is operated by a hydraulic pressure generated by the electric oil pump at the start of the engine when the oil pump driven by the engine cannot generate a sufficient hydraulic pressure.

An automatic engine-stopping and starting system is also known from Japanese Patent Application Laid-open No. 6-101606, which is designed so that a lubricating oil is supplied to portions of an engine, which are to be lubricated, by an electric hydraulic pump prior to the start of the engine, thereby preventing the portions from being abnormally worn at the start of the engine.

However, the automatic engine-stopping and starting system described in Japanese Patent Application Laid-open No. 8-14076 requires the large-sized accumulator, and the automatic engine-stopping and starting system described in Japanese Patent Application Laid-open No. 2000-46165 requires the electric oil pump. Therefore, these systems suffer from increased cost, energy consumption, and battery consumption.

SUMMARY OF THE INVENTION

It is an object of the present invention to ensure that the hydraulic pressure for operating the hydraulic clutch of the transmission and/or the hydraulic pressure for lubricating the engine is raised promptly by using a hydraulic motor to start the engine.

For example, a hydraulic engine-starting system can be provided in a vehicle and include an engine and a transmission that transmits an output from the engine to driven wheels in a speed-changing manner. A hydraulic pressure source generates a hydraulic pressure, while an accumulator accumulates the hydraulic pressure generated thereby. A hydraulic motor starts the engine and a first oil passage supplies oil from the accumulator to the hydraulic motor while a second oil passage returns the oil from the hydraulic motor to the hydraulic pressure source. Oil flowing through the second oil passage is used as a working oil for the transmission and/or a lubricating oil for the engine.

With the above arrangement, the hydraulic motor can be driven by the oil supplied thereto from the accumulator via the first oil passage and the engine cranked and started by a driving force generated by the hydraulic motor. Since the oil discharged from the hydraulic motor maintains a sufficient hydraulic pressure and the transmission and/or engine is disposed at an intermediate portion of the second oil passage, the oil can be used as the working oil for the transmission and/or the lubricating oil for the engine. Therefore, the hydraulic pressure in the transmission can be raised simultaneously with the start of the engine by the hydraulic motor, thereby starting the vehicle without generating any shock due to the engagement of the hydraulic clutch. Alternatively or concurrently, portions of the engine, which are to be lubricated, can be lubricated simultaneously with the start of the engine by the hydraulic motor, to thereby prevent abnormal wear.

The hydraulic engine-starting system can also include a third oil passage that circulates the oil between the transmission or the engine and an oil cooler, wherein at least one portion of the third oil passage also serves as at least one portion of the second oil passage.

With the above arrangement, since at least one portion of the third oil passage also serves as at least one portion of the second oil passage, the length of the second oil passage is minimized.

Another aspect of the hydraulic engine-starting system is an oil pump driven by the hydraulic motor, wherein the oil supplied from the oil pump is used as a working oil for the transmission and/or a lubricating oil for the engine.

With the above arrangement, the hydraulic motor can be driven by the oil supplied thereto from the accumulator via the first oil passage and the engine cranked and started by a driving force generated by the hydraulic motor. In addition, the oil supplied from the oil pump is used as the working oil for the transmission and/or as the lubricating oil for the engine. Therefore, the hydraulic pressure in the transmission can be raised simultaneously with the start of the engine by the hydraulic motor, to thereby start the vehicle without generating shock due to the engagement of the hydraulic clutch. Alternatively or concurrently, portions of the engine, which are to be lubricated, can be lubricated simultaneously with the start of the engine by the hydraulic motor, to thereby prevent abnormal wear.

According to yet another aspect of the hydraulic engine-starting system, an oil supply device can be operated by the oil flowing through the first oil passage, wherein the oil supplied from the oil supply device is used as a working oil for the transmission and/or a lubricating oil for the engine.

With the above arrangement, the hydraulic motor can be driven by the oil supplied thereto from the accumulator via the first oil passage and the engine cranked and started by a driving force generated by the hydraulic motor. In addition, the oil supplied from the oil supply device is used as the working oil for the transmission and/or as the lubricating oil for the engine. Therefore, the hydraulic pressure in the transmission can be raised simultaneously with the start of the engine by the hydraulic motor, to thereby start the vehicle without generating shock due to the engagement of the hydraulic clutch. Alternatively or concurrently, portions of the engine, which are to be lubricated, can be lubricated simultaneously with the start of the engine by the hydraulic motor, to thereby prevent abnormal wear.

Moreover, a reservoir for the transmission can also be used as a reservoir for the hydraulic pressure source.

With the above arrangement, the reservoir for the transmission is also used as the reservoir for the hydraulic pressure source and hence, it is unnecessary to mount a separate reservoir in the hydraulic pressure source, leading to a reduction in number of parts.

Furthermore, an oil pump can be used as the hydraulic pressure source in the present invention.

DETAILED DESCRIPTION OF PREFERRED EMBODIMENTS

The mode for carrying out the present invention will now be described by way of embodiments of the present invention with reference to the accompanying drawings.

A first embodiment of the present invention will be described below with reference to FIGS. 1 and 2.

Figure 1:
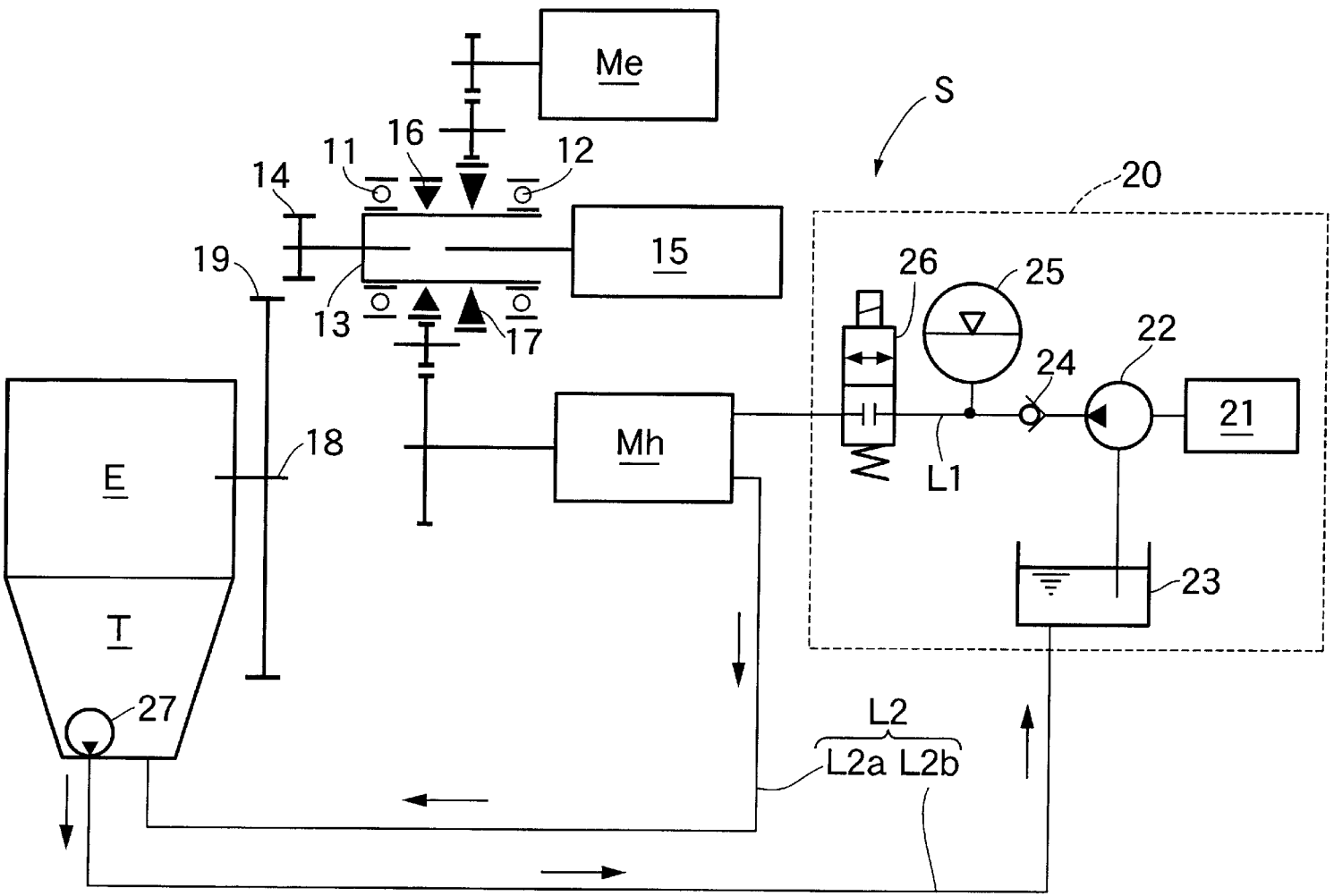
FIG. 1 is a schematic diagram of a hydraulic engine-starting system according to a first embodiment of the present invention.

As shown in FIG. 1, a transmission T is integrally coupled to an engine E having automatically stopping and starting functions, and a starting system S is mounted to the engine E. The starting system S includes a starter shaft 13 supported on a pair of bearings 11 and 12. A drive gear 14 that is relatively non-rotatable and axially movable is carried on the starter shaft 13. An electromagnetic actuator 15 that axially advances and retracts the drive gear 14 is also provided in the starting system S. A hydraulic motor Mh drives the starter shaft 13 through a one-way clutch 16, while an electric motor Me drives the starter shaft 13 through a one-way clutch 17. Therefore, in a state in which the drive gear 14 is advanced by the electromagnetic actuator 15 and meshes with a driven gear 19 provided on a crankshaft 18 of the engine E, the crankshaft 18 can be cranked through the starter shaft 13, the drive gear 14, and the driven gear 19 by driving the hydraulic motor Mh and the electric motor Me to start the engine E.

A hydraulic motor-driving device 20 that drives the hydraulic motor Mh includes a pump-driving motor 21, an oil pump 22 that is driven by the pump-driving motor 21, a reservoir 23 connected to an intake port of the oil pump 22, and a check valve 24, an accumulator 25, and a solenoid valve 26, which are disposed sequentially from an upstream side to a downstream side of a first oil passage L1 that connects a discharge port of the oil pump 22 with the hydraulic motor Mh. The hydraulic motor Mh and the reservoir 23 are connected to each other by a second oil passage L2. The transmission T is disposed between an upstream portion L2*a* and a downstream portion L2*b* of the second oil passage L2. An oil return pump 27 that returns oil to the reservoir 23 through the downstream portion L2*b* of the second oil passage L2 is positioned within the transmission T.

The transmission T is provided with a hydraulic circuit including a hydraulic clutch, a torque converter, a control valve and other such conventional features. The hydraulic circuit is operated by hydraulic pressure that is generated by an oil pump (not shown) driven by the engine E. The second oil passage L2 is connected to the hydraulic circuit of the transmission T.

With the above-mentioned arrangement, the engine E having the automatically stopping and starting functions is automatically stopped by cutting off the supply of fuel when a vehicle is decelerated and stopped at an intersection, and is automatically started when a driver depresses an accelerator pedal. The starting of the engine E is carried out by the hydraulic motor Mh. Oil is discharged by the oil pump 22, which is operated by the pump-driving motor 21, and accumulates in the accumulator 25. Upon depressing the accelerator pedal, the solenoid valve 26 is opened for a predetermined period of time e.g., for 0.2 seconds, and oil from the accumulator 25 is supplied to the hydraulic motor Mh. Thus, the crankshaft 18 is cranked by the hydraulic motor Mh, which starts the engine E.

The electric motor Me is used to start the engine E in such a circumstance where the hydraulic motor Mh or its driving system cannot be operated normally. Therefore, the electric motor Me is not used in a usual or common state. When the hydraulic motor Mh is driven, a driving force from the hydraulic motor Mh is cut off by the one-way clutch 17 so that the driving force cannot be transmitted to the electric motor Me. Likewise, when the electric motor Me is driven, a driving force from the electric motor Me is cut off by the one-way clutch 16 so that the driving force cannot be transmitted to the hydraulic motor Mh.

Figure 2:
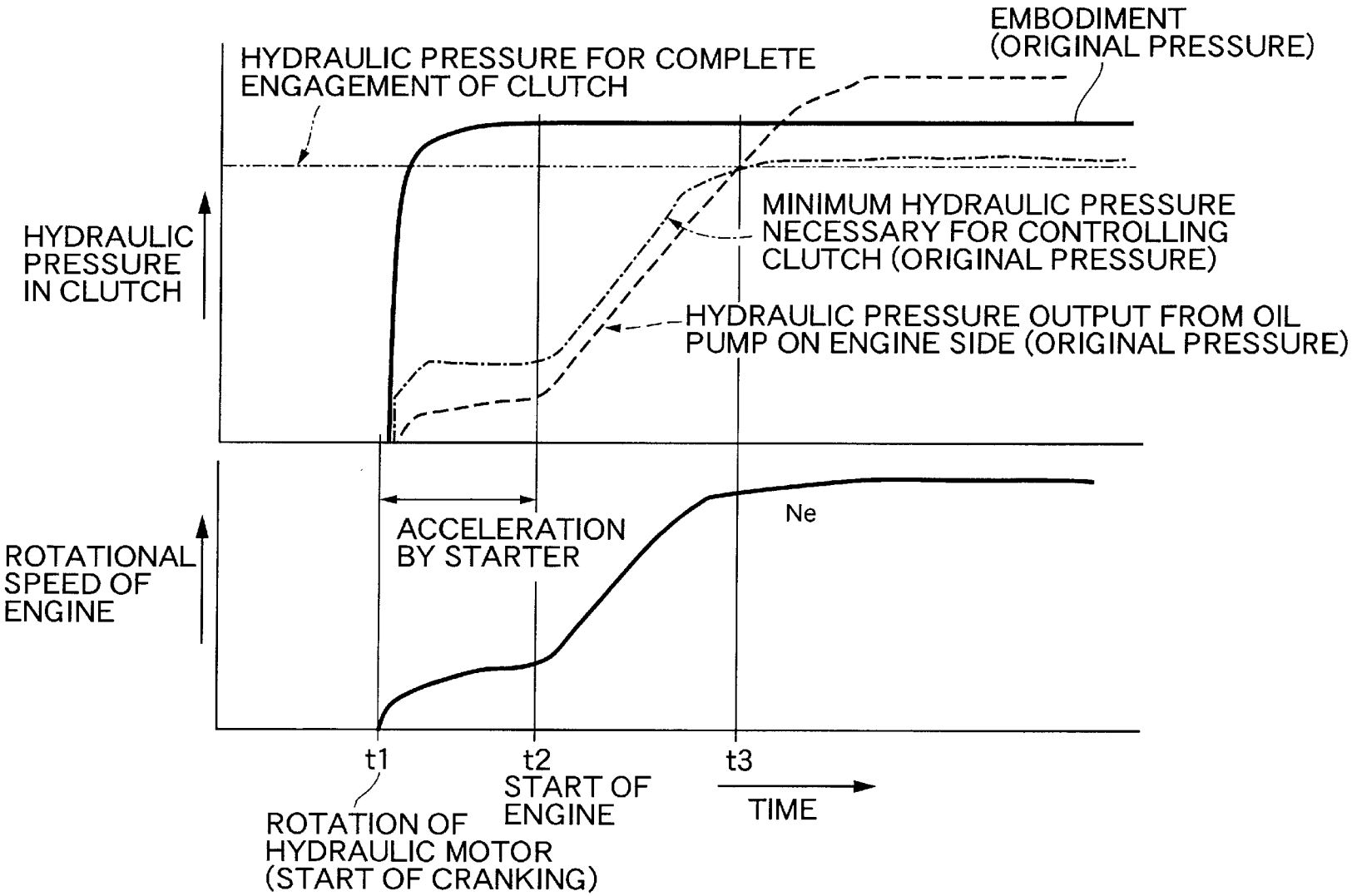
FIG. 2 is a time chart explaining the operation of the first embodiment.

Referring to FIG. 2, the hydraulic motor Mh is driven at time t1 to start the cranking of the engine, and the engine E is started at time t2. In this case, a hydraulic pressure, indicated by the broken line in FIG. 2, output from the oil pump driven by the engine E increases slowly in conjunction with an increase in the rotational speed of the engine. Therefore, a hydraulic pressure, indicated by the dashed line in FIG. 2, required to appropriately control the hydraulic clutch of the transmission T, is provided at time t3 after a predetermined period of time from the start of the engine E lapses, and the vehicle cannot be started before time t3. When the hydraulic clutch is brought into engagement at time t3, a shock is generated by the engagement of the hydraulic clutch, which impedes the smooth start because the rotational speed of the engine has been increased to a level higher than a required rotational speed.

According to the first embodiment, however, when the hydraulic motor Mh is operated at time t1, the oil discharged from the hydraulic motor Mh still has a sufficient hydraulic pressure such that the oil is supplied via the second oil passage L2 to the transmission T simultaneously with the operation of the hydraulic motor Mh. Thus, the hydraulic pressure in the transmission T is raised immediately to exceed the required hydraulic pressure. Therefore, the vehicle can be started without delay simultaneously with the start of the engine E and without generating the shock associated with the engagement of the hydraulic clutch. Since the solenoid valve 26 is closed upon starting the engine E, the oil passed through the hydraulic motor Mh cannot be supplied to the transmission T. However, the oil pump already being driven by the engine E supplies a sufficient amount of the oil to the transmission T at this time. Accordingly, the operation of the transmission T can be continued without hindrance.

As discussed above, the hydraulic motor Mh can be driven by the oil supplied thereto from the accumulator 25 for accumulating the hydraulic pressure generated by the hydraulic pressure source or oil pump 22 through the first oil passage L1. The engine E can then be cranked and started by the driving force generated by the hydraulic motor Mh. Since the oil discharged from the hydraulic motor Mh still has a sufficient hydraulic pressure, the transmission T and/or engine E is disposed at the intermediate portion of the second oil passage L2 for returning the oil to the hydraulic pressure source 22, thus the oil can be used as the working oil for the transmission T and/or as the lubricating oil for the engine E. Therefore, the hydraulic pressure in the transmission T can be raised simultaneously with the start of the engine E by the hydraulic motor Mh to thus start the vehicle without generating any shock due to the engagement of the hydraulic clutch. Alternatively or concurrently, the portions of the engine E, which are to be lubricated, can be lubricated simultaneously with the start of the engine E by the hydraulic motor Mh, to prevent abnormal wear.

Figure 3:
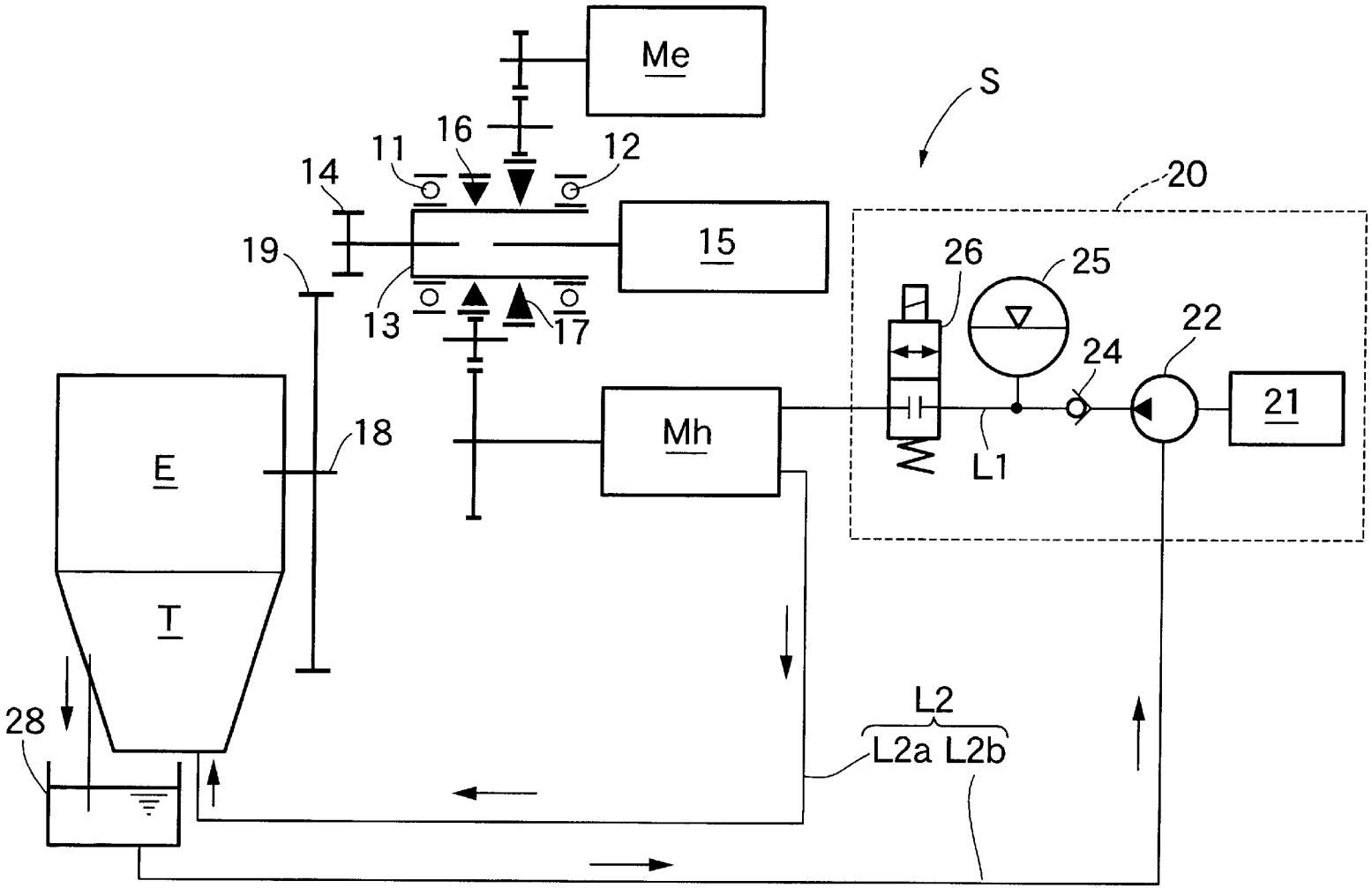
FIG. 3 is a schematic diagram of a hydraulic engine-starting system according to a second embodiment.

A second embodiment of the present invention will be described below with reference to FIG. 3.

The second embodiment differs from the first embodiment in that the hydraulic motor-driving device 20 is not provided with the reservoir 23. Rather, a reservoir 28 is provided in the transmission T that also serves as a reservoir for the hydraulic motor-driving device 20, which provides for a reduction in the number of parts. In the second embodiment, the intake port of the oil pump 22 is connected directly to a downstream end of the second oil passage L2. Thus, it is unnecessary to mount the oil return pump 27 (see FIG. 7) in the transmission T with the purpose of returning the oil to the hydraulic motor-driving device 20, which provides for a further reduction in the number of parts.

Figure 4:
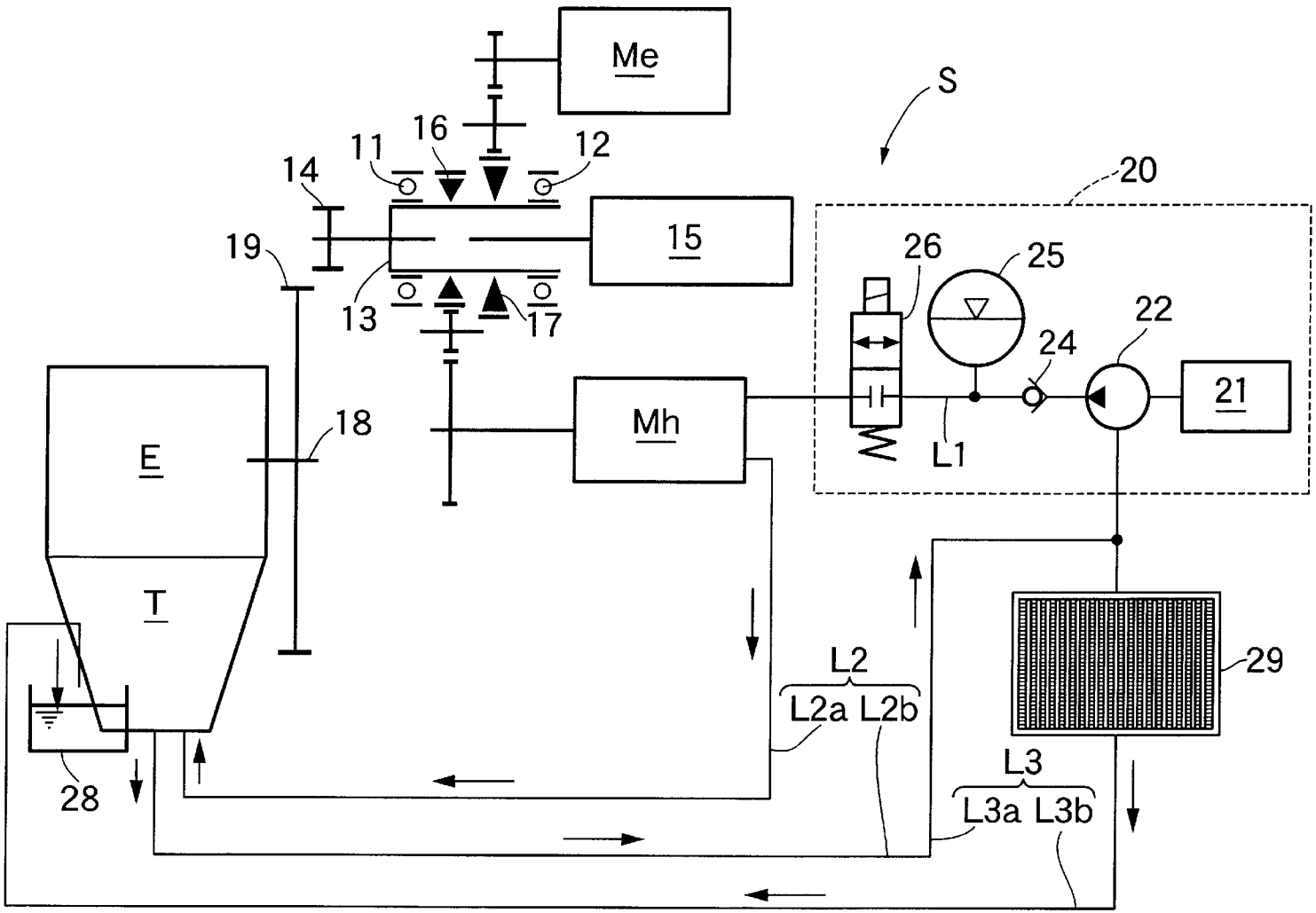
FIG. 4 is a schematic diagram of a hydraulic engine-starting system according to a third embodiment.

A third embodiment of the present invention will be described below with reference to FIG. 4.

The third embodiment differs from the second embodiment in that an oil cooler 29 is provided within a third oil passage L3 that connects the hydraulic circuit (not shown) of the transmission T with the reservoir 28. The third oil passage L3 includes an upstream section L3*a* extending from the hydraulic circuit of the transmission T to the oil cooler 29, while a downstream section L3*b* extends from the oil cooler 29 to the reservoir 28. A portion of the upstream section L3*a* of the third oil passage L3 is also used as a portion of the downstream section L2*b* of the second oil passage L2. In this manner, using a portion of the third oil passage L3 for the oil cooler 29 as a portion of the second oil passage L2 for the starting system S reduces the overall length of the oil passage.

In other words, since at least one portion of the third oil passage 13 used to circulate the oil to the oil cooler 29 also serves as at least one portion of the second oil passage L2, the overall length of the second oil passage L2 used to operate the hydraulic motor Mh is minimized.

Figure 5:
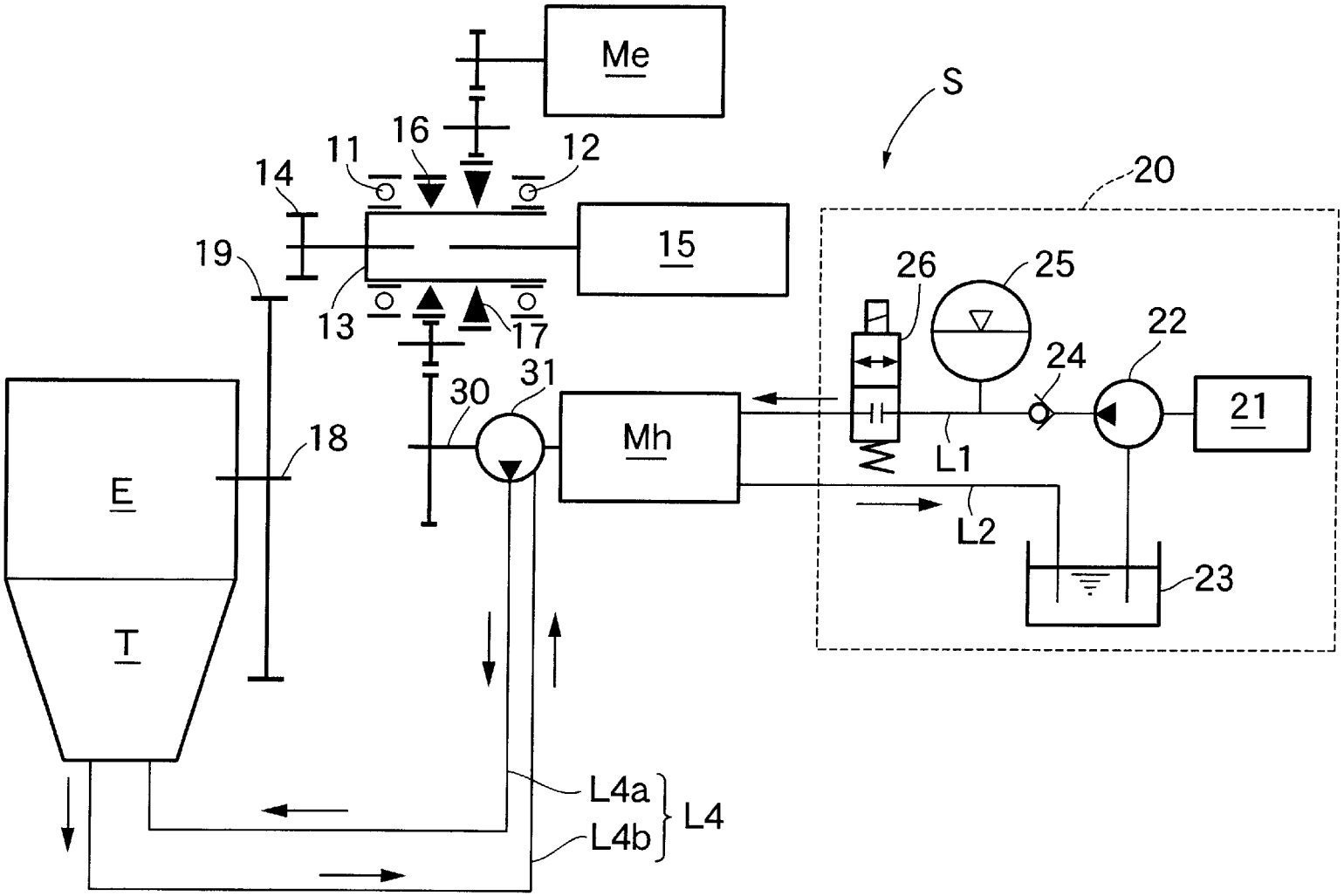
FIG. 5 is a schematic diagram of a hydraulic engine-starting system according to a fourth embodiment.

A fourth embodiment of the present invention will be described below with reference to FIG. 5.

The fourth embodiment includes an oil pump 31 mounted to an output shaft 30 of the hydraulic motor Mh. A discharge port of the oil pump 31 and the transmission T are connected to each other by an upstream section L4*a* of a fourth oil passage L4, while the transmission T and intake port of the oil pump 31 are connected to each other by a downstream section L4*b* of the fourth oil passage L4.

The instant the hydraulic motor Mh is operated to start the engine E, the oil pump 31 is operated to supply the oil to the hydraulic circuit (not shown) of the transmission T. Therefore, the hydraulic pressure in the transmission T can be raised simultaneously with the start of the engine E to start the vehicle immediately. Moreover, a working oil for the hydraulic circuit of the transmission T and a working oil for the hydraulic motor Mh are completely separate from each other. Thus, it is possible to prevent a trouble from occurring in the hydraulic circuit of the transmission T, which is susceptible to contamination by foreign matters, due to the provision of a large number of control valves. The hydraulic motor Mh can use a working oil that is different from the working oil used for the transmission T. Moreover, the number of parts exposed to the high-temperature working oil for the transmission T is reduced.

According to the fourth embodiment, the hydraulic motor Mh can be driven by the oil supplied thereto from the accumulator 25 to accumulate the hydraulic pressure generated by the hydraulic pressure source 20 through the first oil passage L1. Then, the engine E can be cranked and started by the driving force generated by the hydraulic motor Mh. In addition, the oil supplied from the oil pump 31 driven by the hydraulic motor Mh is used as the working oil for the transmission T and/or as the lubricating oil for the engine E. Therefore, the hydraulic pressure in the transmission T can be raised simultaneously with the start of the engine E by the hydraulic motor Mh, which provides for the starting of the vehicle without generating any shock due to the engagement of the hydraulic clutch. Alternatively or concurrently, the portions of the engine E, which are to be lubricated, can be lubricated simultaneously with the start of the engine E by the hydraulic motor Mh, which also prevent abnormal wear.

Figure 6:
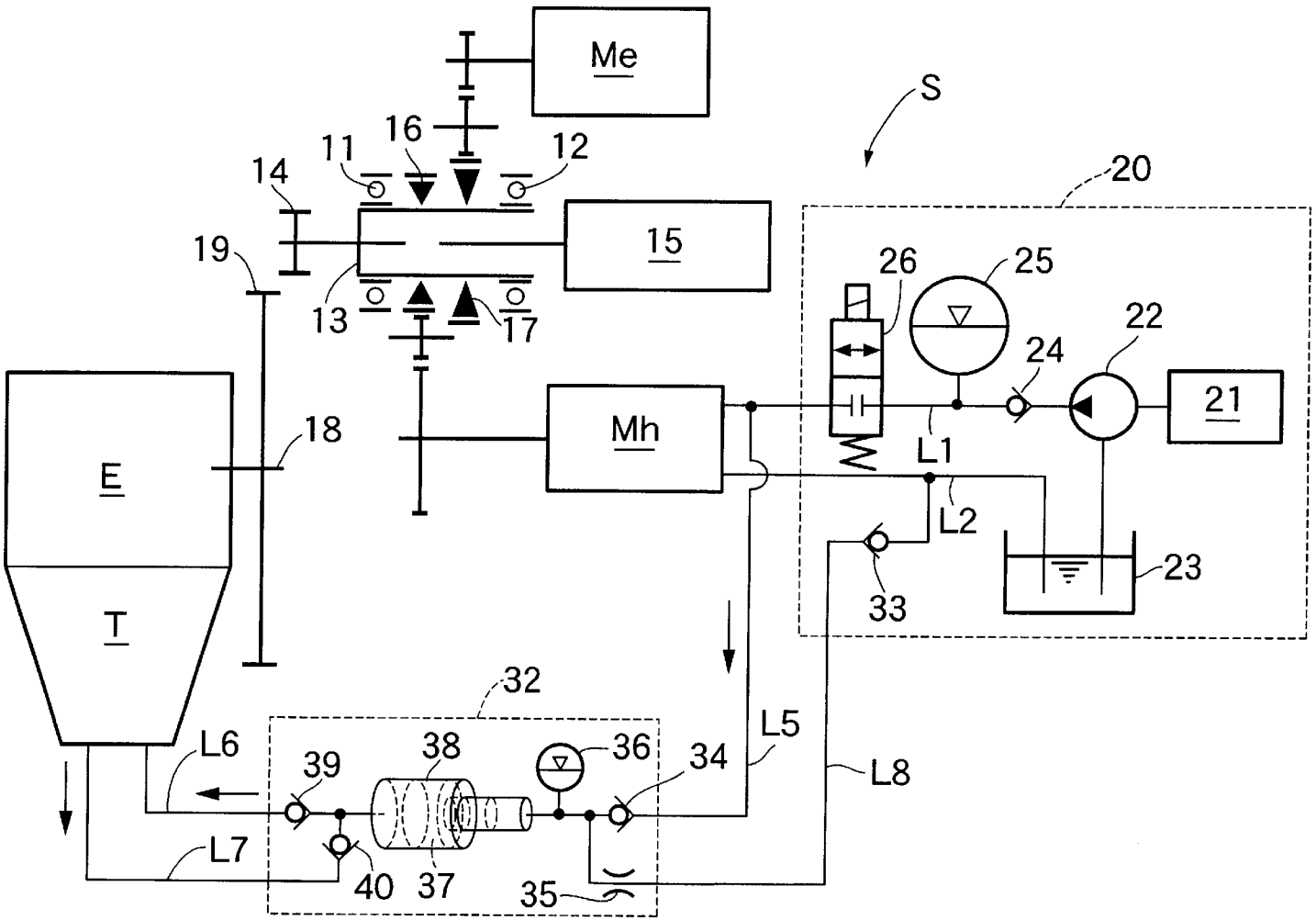
FIG. 6 is a schematic diagram of a hydraulic engine-starting system according to a fifth embodiment.
Figure 7:
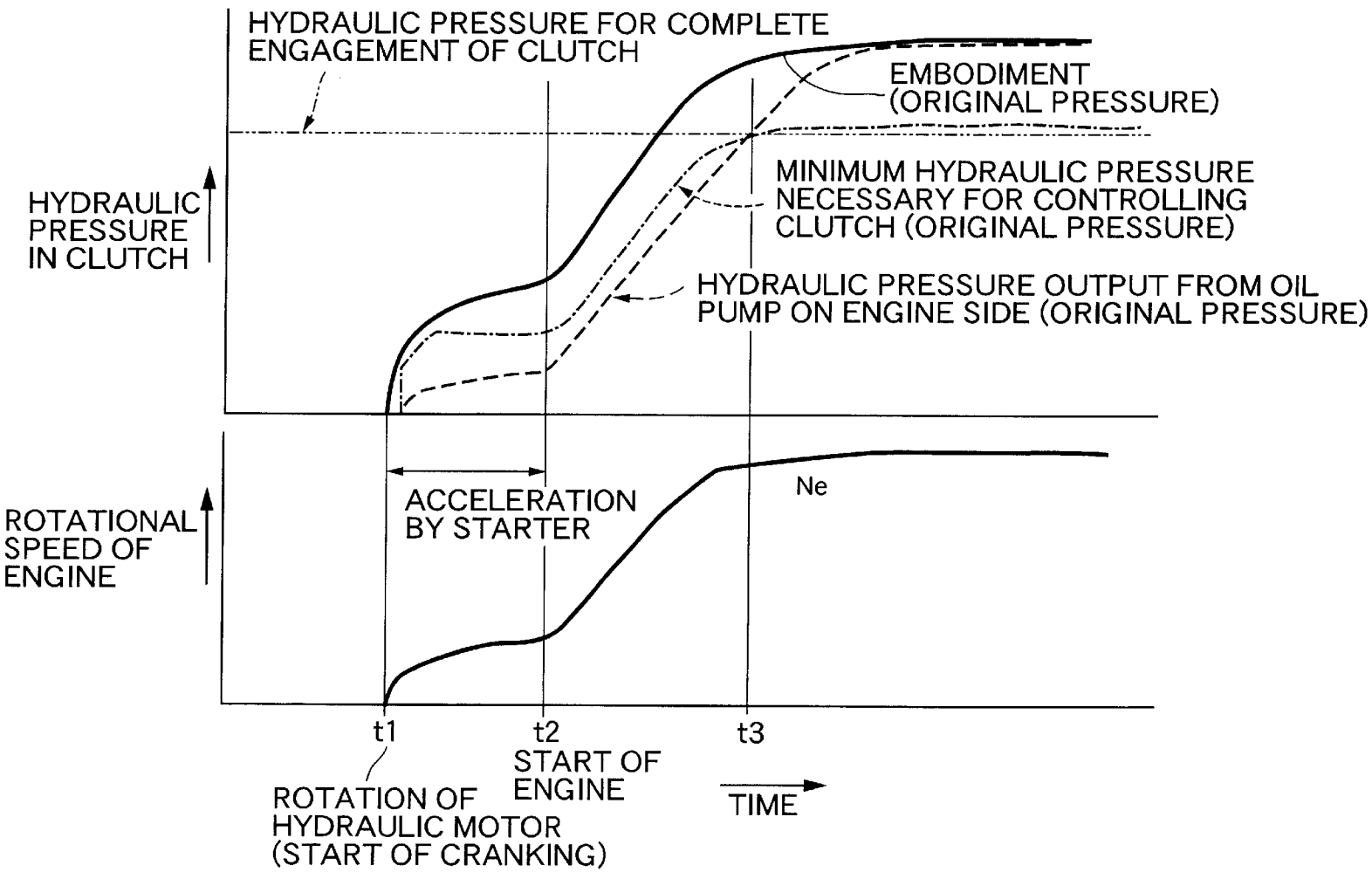
FIG. 7 is a time chart explaining the operation of the fifth embodiment.

A fifth embodiment of the present invention will be described below with reference to FIGS. 6 and 7.

The fifth embodiment includes a fifth oil passage L5 branched from the first oil passage L1 at a location downstream of the solenoid valve 26 that communicates with an inlet port of an oil supply device 32. An eighth oil passage L8 communicating with a discharge port of the oil supply device 32 communicates with the second oil passage L2 through a check valve 33. The oil supply device 32 includes a check valve 34, a constriction 35 connected in parallel to the check valve 34, an accumulator 36 constituting a retarding means, and a stepped cylinder 38 in which a stepped piston 37 is slidably received. A smaller-diameter portion of the cylinder 38 communicates with the fifth oil passage L5, while a larger-diameter portion of the cylinder 38 communicates with the transmission T through a sixth oil passage L6 also having a check valve 39. An intermediate portion of the sixth oil passage L6 and the transmission T communicate with each other through a seventh oil passage L7, which also has a check valve 40.

Thus, when the solenoid valve 26 is opened for a predetermined time, the hydraulic motor Mh is operated to start the engine E. Simultaneously, a hydraulic pressure is applied to a port in the smaller-diameter portion of the stepped cylinder 38 through the check valve 34 to move the piston 37 leftwards. This causes the hydraulic pressure generated in a port in the larger-diameter portion of the stepped cylinder 38 to be supplied to the transmission T to operate the hydraulic circuit. As such, the vehicle can be started simultaneously with the start of the engine without generating any shock due to the engagement of the hydraulic clutch.

The operation at that time will be described in further detail. The hydraulic pressure supplied the instant the solenoid valve 26 is opened accumulates instantaneously in the accumulator 36 of the oil supply device 32. Furthermore, the hydraulic pressure is supplied slowly from the accumulator 36 constituting the retarding means to the port of the smaller-diameter portion of the stepped cylinder 38, which drives the piston 37. Presuming the accumulator 36 is not provided, it is not possible to drive the piston 37 the necessary strokes merely by opening the solenoid valve 26 for a short period of time, e.g., for 0.2 seconds.

For example, if the ratio of the area between the smaller-diameter portion and the larger-diameter portion of the piston 37 is 1:10 and oil in an amount of 3 cc is supplied from the accumulator 36 having an accumulated hydraulic pressure of, for example, 30 MPa, and the internal pressure in the accumulator 36 drops to 10 MPa, the oil having a pressure of 1 MPa can be supplied in an amount of 30 cc from the cylinder 38 to the transmission T. As such, the pressure and flow rate of the oil supplied to the transmission T can be set at any value via the oil supply device 32. Therefore, if the hydraulic pressure of the oil supplied from the oil supply device 32 to the transmission T varies as shown in FIG. 7 and is set to slightly exceed a hydraulic pressure, indicated by the dashed line in FIG. 7, required for appropriately controlling the hydraulic clutch of the transmission as shown by a solid line in FIG. 7, the consumption of the oil accumulated in the accumulator 25 can be suppressed. Also, the electric power consumed by the pump-driving motor 21 needed to drive the oil pump 22 can be suppressed to a minimum, thereby contributing to the retrenchment of energy and reducing the capacity of the accumulator 25.

When the oil pump driven by the engine E exhibits a sufficient function after the start of the engine E, the piston 37 is moved rightwards by the oil returned from the transmission T to the oil supply device 32 through the check valve 40. Oil is then forced out of the cylinder 38 and returned through the constriction 35 and check valve 33 to the reservoir 23 of the hydraulic motor-driving device 20. The constriction 35 is selected to have a diameter and length so that an influence is not exerted as much as possible during operation of the oil supply device 32, i.e., while supplying oil to the transmission T.

The instant the hydraulic motor Mh is operated to start the engine E, the oil supply device 32 supplies oil to the hydraulic circuit of the transmission T. Thus, the hydraulic pressure in the transmission T can be raised simultaneously with the start of the engine E to start the vehicle immediately. Moreover, since the working oil for the hydraulic circuit of the transmission T and the working oil for the hydraulic motor Mh are completely separated from each other, it is possible to prevent trouble from occurring in the hydraulic circuit of the transmission T, which is susceptible to contamination by foreign matters, due to the provision of the large number of control valves.

Therefore, the hydraulic motor Mh can be driven by the oil supplied thereto from the accumulator 25 for accumulating the hydraulic pressure generated by the hydraulic pressure source 22 through the first oil passage L1, and the engine E can be cranked and started by the driving force generated by the hydraulic motor Mh. In addition, the oil supplied from the oil supply device 32 operated by the oil flowing through the first oil passage L1 is used as the working oil for the transmission T and/or as the lubricating oil for the engine E. Therefore, the hydraulic pressure in the transmission T can be raised simultaneously with the start of the engine E by the hydraulic motor to start the vehicle without generating any shock due to the engagement of the hydraulic clutch. Alternatively or concurrently, portions of the engine E, which are to be lubricated, can be lubricated simultaneously with the start of the engine E by the hydraulic motor Mh, thereby preventing abnormal wear.

In each of the embodiments of the present invention, the working oil has been described as a working oil for bringing the hydraulic clutch of the transmission T into engagement, but may be considered as a lubricating oil for lubricating various portions of the transmission T.

Although the embodiments of the present invention have been described, it will be understood that various modifications may be made without departing from the subject matter of the present invention.

For example, in the preferred embodiments, the working oil is supplied to the transmission simultaneously with the start of the engine E, thereby enabling the prompt starting of the vehicle, while avoiding the shock by engagement of the hydraulic clutch, but the lubricating oil may be supplied to portions of the engine E, which are to be lubricated, simultaneously with the start of the engine, whereby the abnormal wearing of such portions to be lubricated can be avoided.

In the third embodiment, the portion of the upstream section L3*a* of the third oil passage L3 is used as the portion of the downstream section L2*b* of the second oil passage L2, but a portion of the downstream section L3*b* of the third oil passage L3 may be used as a portion of the downstream section L2*b* of the second oil passage L2.

Even in the first to fourth embodiments, the original hydraulic pressure can be set to slightly exceed a necessary lowest hydraulic pressure, as in the fifth embodiment.

Moreover, the reservoir for the transmission T can also be used as the reservoir for the hydraulic pressure source 20 and hence, it is unnecessary to mount a separate reservoir in the hydraulic pressure source 20, which leads to a reduction in the number of parts.

What is claimed is:

1. A hydraulic engine-starting system in a vehicle, comprising:

an engine;

a transmission that transmits an output from said engine to driven wheels in a speed-changing manner;

a hydraulic pressure source that generates a hydraulic pressure;

an accumulator that accumulates the hydraulic pressure generated by said hydraulic pressure source;

a hydraulic motor that starts said engine;

a first oil passage that supplies oil from said accumulator to said hydraulic motor; and a second oil passage that supplies the oil from said hydraulic motor to said transmission and/or said engine, and returns the oil therefrom to said hydraulic pressure source, wherein the oil flowing through said second oil passage is used as a working oil for said transmission and/or a lubricating oil for said engine.

2. The hydraulic engine-starting system according to claim 1, further comprising a reservoir disposed within said second oil passage between said engine and said hydraulic pressure source, wherein the reservoir is used by said transmission and said hydraulic pressure source.

3. The hydraulic engine-starting system according to claim 2, wherein the reservoir is connected to an intake port of said hydraulic pressure source.

4. The hydraulic engine-starting system according to claim 3, further comprising an oil return pump provided within said transmission, wherein the oil return pump returns oil to the reservoir through said second oil passage.

5. The hydraulic engine-starting system according to claim 1, further comprising a third oil passage that circulates the oil between said transmission or said engine and an oil cooler, wherein at least one portion of said third oil passage serves as at least one portion of said second oil passage.

6. A hydraulic engine-starting system in a vehicle, comprising:

an engine;

a transmission that transmits an output from said engine to driven wheels in a speed-changing manner;

a hydraulic pressure source that generates a hydraulic pressure;

an accumulator that accumulates the hydraulic pressure generated by said hydraulic pressure source;

a hydraulic motor that starts said engine;

a first oil passage that supplies an oil from said accumulator to said hydraulic motor;

a second oil passage that returns the oil from said hydraulic motor to said hydraulic pressure source; and an oil pump that is driven by said hydraulic motor, wherein the oil supplied from said oil pump is supplied to said transmission and/or said engine and is used as a working oil for said transmission and a lubricating oil for said engine.

7. The hydraulic engine-starting system according to claim 6, further comprising a reservoir disposed within said second oil passage between said hydraulic motor and said hydraulic pressure source.

8. The hydraulic engine-starting system according to claim 7, wherein the reservoir is used by said transmission and said hydraulic pressure source.

9. The hydraulic engine-starting system according to claim 6, further comprising a third oil passage that supplies oil from said oil pump to either one of said engine and transmission.

10. A hydraulic engine-starting system in a vehicle, comprising:

an engine;

a transmission that transmits an output from said engine to driven wheels in a speed-changing manner;

a hydraulic pressure source that generates a hydraulic pressure;

an accumulator that accumulates the hydraulic pressure generated by said hydraulic pressure source;

a hydraulic motor that starts said engine;

a first oil passage that supplies an oil from said accumulator to said hydraulic motor;

a second oil passage that returns the oil from said hydraulic motor to said hydraulic pressure source; and an oil supply device operated by the oil flowing through said first oil passage, wherein the oil supplied from said oil supply device is supplied to said transmission and/or said engine and is used as a working oil for said transmission and/or a lubricating oil for said engine.

11. The hydraulic engine-starting system according to claim 10, further comprising a reservoir disposed within said second oil passage.

12. The hydraulic engine-starting system according to claim 11, wherein the reservoir is used by said transmission and said hydraulic pressure source.

* * * * *